United States Patent [19]

Wunderlich

[11] Patent Number: 4,480,689

[45] Date of Patent: Nov. 6, 1984

[54] BLOCK PATTERN METHOD FOR IN SITU GASIFICATION OF SUBTERRANEAN CARBONACEOUS DEPOSITS

[75] Inventor: Donald K. Wunderlich, Richardson, Tex.

[73] Assignee: Atlantic Richfield Company, Los Angeles, Calif.

[21] Appl. No.: 446,900

[22] Filed: Dec. 6, 1982

[51] Int. Cl.[3] ..... E21B 43/243; E21B 43/30; E21C 43/00

[52] U.S. Cl. ..... 166/245; 166/256

[58] Field of Search ..... 166/245, 256, 259

[56] References Cited

U.S. PATENT DOCUMENTS 2,777,679 1/1957 Ljungstrom ..... 166/245 X 2,841,375 7/1958 Salomonsson ..... 166/245

3,999,607 12/1976 Pennington et al. ..... 166/259

4,306,621 12/1981 Boyd et al. ..... 166/245

*Primary Examiner*—Stephen J. Novosad

*Attorney, Agent, or Firm*—Robert M. Betz

[57] ABSTRACT

Any desired number of alternate parallel rows of injection and production well bores are positioned to establish a block gasification pattern. Combustion links are established between adjacent injection and production well bores in a direction generally perpendicular to said rows. The block pattern is ignited simultaneously through all of the injection well bores such that the pattern is gasified along the multiple linking paths in both directions between each injection well bore and its adjacent production well bores. In this manner the entire area of deposit defined by the block pattern is gasified simultaneously and may be separated from other similar block patterns by a barrier, thereby eliminating the problem of direct contact with burned-out areas.

5 Claims, 2 Drawing Figures

BLOCK PATTERN METHOD FOR IN SITU GASIFICATION OF SUBTERRANEAN CARBONACEOUS DEPOSITS

BACKGROUND OF THE INVENTION

This invention relates to methods for gasifying subterranean carbonaceous deposits and more particularly to methods for gasifying such deposits with the aid of specific patterns of injection and production well bores.

One prior art process for gasifying subterranean carbonaceous deposits such as coal over a wide area is known as the "line drive process". In that process, well bores are drilled at suitable spacing in parallel rows extending generally perpendicular to the direction of the line drive, i.e., the direction in which the gasification or burn front is to progress. After a combustion link is established between two adjacent rows of well bores by well-known means, a free oxygen containing gas is injected into the well bores of one such row (the injection wells) with ignition and gasification of the carbonaceous deposit being accomplished between the two rows, gasification product gas being recovered from the well bores of the second of the two rows (the production wells).

When it is desired to continue the gasification of the deposit in the same line drive direction, the production wells are converted to injection wells with gasification occurring between such wells and a succeeding adjacent row of well bores which now become the production wells for the next gasification pattern of the line drive.

One drawback with a line drive pattern of this type is the use of well bores for both injection and production, which results in less efficient gasification of the subterranean deposit than could be accomplished if the wells were used for a single purpose, either injection or production. The reason is that when linking is attempted from a well which has been previously used for either injection or production, it is difficult to control the position of the combustion link in the deposit so that combustion can be initiated near the bottom of the subterranean deposit, which is known to be a desirable objective in this art.

Another problem inherent in any line drive process of the type described is the problem of water influx into the gasification zone from the surrounding areas. Since coal seams tend to act as aquifers, natural water will seek to travel through a coal seam except when interrupted, such as by sufficiently high pressures accompanying gasification. However, some encroachment of such water into any gasification pattern is inevitable. The greater the length of the outer perimeter of the pattern undergoing gasification at any given time in relation to its cross-sectional area, the greater the amount of such water influx which may interfere with combustion efficiency. Since the conventional short-spacing line-drive pattern described above extends at any given time only the distance between two adjacent rows of well bores, such a pattern possesses a relatively long length of exposed perimeter in relation to the area undergoing gasification.

A further problem with the aforementioned conventional line drive is that each succeeding gasification pattern in the direction of the line drive is necessarily in direct contact with a previously burned-out pattern. As a result, gasification products generated in the succeeding pattern may escape to the surface through such burned-out zone, with consequent environmental pollution and personnel hazard.

It is therefore a general object of this invention to provide an improved process whereby to gasify in situ a subterranean carbonaceous deposit.

It is a more specific object of this invention to provide such a process wherein a large area of such carbonaceous deposit may be more efficiently produced.

It is a still further object of this invention to provide a process of in situ gasification of such a carbonaceous deposit in which the problem of water influx is minimized.

Other and further objects and advantages of this invention will become apparent from consideration of the detailed description to follow taken in conjunction with the drawings and the claims appended hereto.

SUMMARY OF THE INVENTION

In practicing the improved process of the present invention, any desired number of alternate parallel rows of injection and production well bores are positioned to establish a block gasification pattern. Combustion links are established between the adjacent injection and production well bores in a direction generally perpendicular to said rows. Thereafter, the block pattern is ignited simultaneously through all of said injection well bores so that the pattern is gasified along the multiple linking paths extending in both directions between each of the injection well bores and its adjacent production well bores. In this manner the entire area of deposit defined by such block pattern is gasified simultaneously.

A BRIEF DESCRIPTION OF THE DRAWINGS

Figure 1:
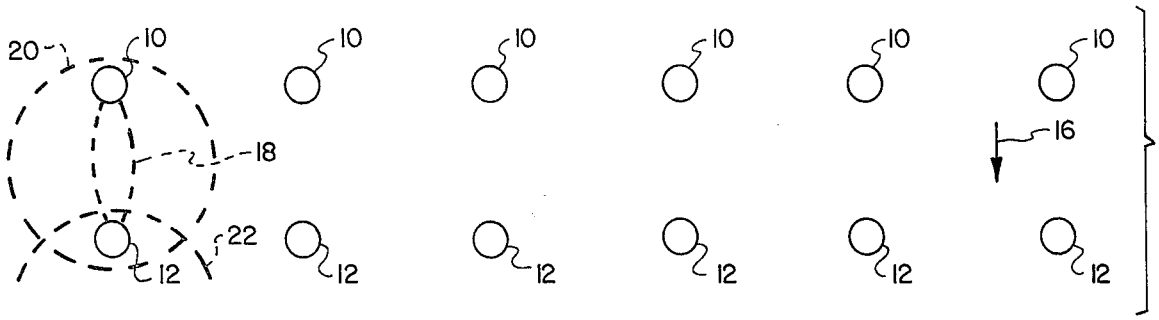
FIG. 1 (PRIOR ART)
FIG. 1 is a diagramatic representation of a line-drive well bore pattern in a subterranean carbonaceous deposit in accordance with the prior art.

With reference now to FIG. 1, there is shown a first row of well bores 10 and a second parallel row of well bores 12 spaced therefrom in the line-drive direction shown by arrow 16. In order to conduct a conventional line-drive process, the row of well bores 10 may be operated as injection well bores and the second row of well bores 12 operated as production well bores. A free-oxygen containing gas such as air, oxygen enriched air, oxygen or the like, is injected into well bores 10 with the underlying carbonaceous deposit being ignited at production well bores 12. A link 18 is then typically established between each of injection well bores 10 and its associated production well bore 12 in the direction 16 by use of reverse combustion linking. A link may also be established by horizontal drilling or the like. For example, in the practice of reverse combustion linking free oxygen containing gas is injected into injection well bores 10 until a significant flow of oxygen is detected from the subterranean deposit at production well 12. When sufficient oxygen flow is detected in production well 12 ignition is accomplished by any of a variety of techniques well known to the art such as the use of pyrophoric materials and the like. Combustion then continues within the deposit until a permeable combustion link 18 is established back to injection well 10.

After the establishment of combustion links 18 gasification is conducted by the injection of free oxygen containing gas into injection well bores 10 at an increased rate together with reignition through such well bores, gasification product gas being recovered from production well bores 12. When gasification has in this fashion been completed in area 20 generally encompassing both well bores 10 and 12, gasification is substantially complete for the pattern. Thereafter production well bores 12 are converted to injection well bores, production being accomplished from a succeeding row of well bores (not shown) in the line-drive direction 16. This process is then continued step by step until any desired area of the deposit has been gasified. It is assumed in this description that all of the areas between all of well bores 10 and 12 are completely gasified before moving on the next succeeding line-drive pattern in the direction 16.

Usage of well bores 12 as both injection and production well bores requires rearrangement of piping to accommodate change in well function. Furthermore production wells are typically burned off near the top of the carbonaceous deposit after gasification is complete. Therefore, there is no convenient way to insure injection of free oxygen containing gas near the bottom of the formation through wells 12. It is, therefore, more difficult to control the combustion of the underlying deposit.

After areas 20 have been gasified and areas 22 of a succeeding line-drive pattern are undergoing gasification, the likelihood increases that the gasification products can reach the surface through the directly-contacted burned-out areas 20 with consequent environmental hazard.

In practicing the improved method of this invention substantially parallel rows of suitably-spaced well bores 24, 26, 28, 30, 32, 34 and 36 may be positioned within a subterranean carbonaceous deposit to establish a block pattern 38. The rows consist alternately of injection and production well bores. For example, well bores 24 may be production well bores and well bores 28, 32 and 36 are then also operated as production well bores. Intermediate rows 26, 30 and 34 constitute injection well bores. In a conventional manner, such as previously described, combustion links may be established between successive rows of injection and production well bores as for example links 34 and 36, the former extending between injection wells 26 and production wells 24 and the latter extending between injection wells 26 and production wells 28. It will be understood that in like manner combustion links are established to interconnect all of the injection and production well bores 24, 26, 28, 30, 32, 34 and 36 in the total block pattern.

In the practice of this invention, after all of the aforementioned combustion links are established, gasification is conducted by injecting free oxygen containing gas simultaneously into injection well bores 26, 30 and 34 with gasification proceeding from each of said injection well bores in opposite directions substantially perpendicular to said rows to the two adjacent production well bores. For example, gasification proceeds from injection well bores 26 in the direction shown by arrow 40 to production well bores 24 and in the direction shown by arrow 42 to production well bores 28, thereby gasifying areas 44 and 46. In like manner the entire block pattern 38 is simultaneously gasified with gasification products being recovered from production well bores 24, 28, 32, and 36 simultaneously.

Among the advantages of this block pattern gasification method is the fact that none of the well bores is used for both injection and production. Therefore, both production and injection wells may be designed for maximum efficiency. In particular, continued usage of either injection wells or production wells as such over their entire life results in greater ease in controlling combustion in the underlying deposit.

Figure 2:
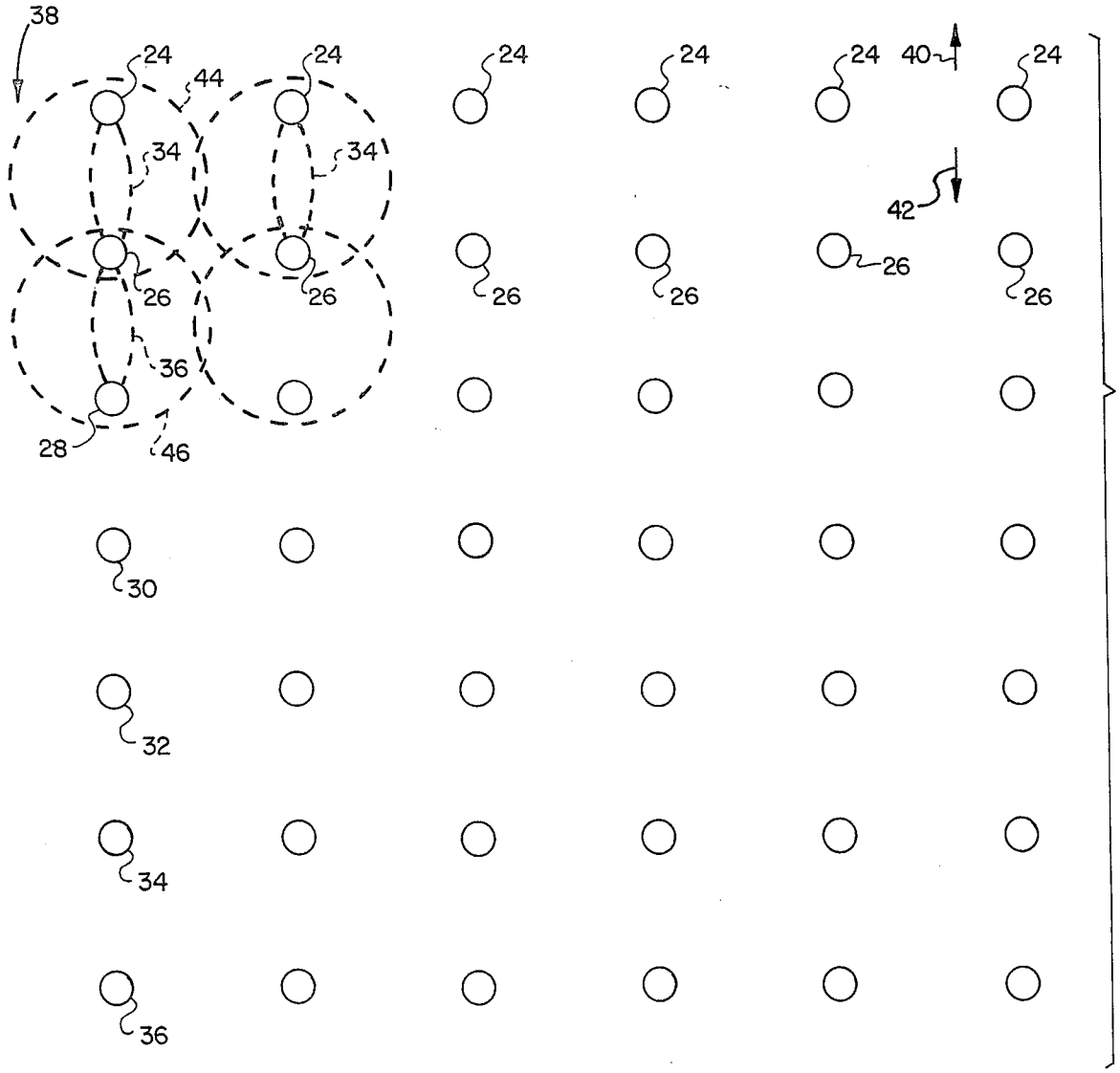
FIG. 2 is a diagramatic representation of a well bore pattern in a subterranean carbonaceous deposit in accordance with a preferred embodiment of this invention.

It is apparent also that the area of deposit undergoing gasification within the block pattern 38 of FIG. 2 at any given time in relation to the exposed perimeter of such block 38 is much greater than the corresponding line drive pattern of FIG. 1. This results in considerably less relative interference with the gasification process by reason of water influx from the surrounding areas.

Further, since the entire area of block pattern 38 is undergoing gasification at the same time, there is no direct contact with burned-out patterns. Subsequent block patterns of the type described can be separated from the previous one by a barrier of any desired spacing. Although the presence of such a barrier sacrifices a certain area of carbonaceous deposit, the percentage of a total large area sacrificed in this manner is quite small, whereas the corresponding loss if individual line-drive patterns were to be separated from each other by such barriers would be completely uneconomical. Therefore, with the use of the block pattern of this invention, a large area of subterranean deposit can be gasified with relatively high efficiency and elimination of unwanted gasification products reaching the surface through burned-out areas.

It should be understood that subterranean carbonaceous deposits suitable for the practice of the present invention include coal of various grades as well as oil shales, tar sands, heavy deposits and the like.

The spacing of the well bores in FIG. 2 may be varied depending upon the particular deposit and process requirements. Increasing well spacing minimizes costs but the wells should be close enough to survive to the point of substantially complete extraction of the surrounding deposit. Such considerations are well within the state of this art.

For maximum efficiency, a block pattern of well bores for use in the present invention should start and end with production well bores as shown and described in FIG. 2. This will minimize the number of injection wells required for gasification of a given area. Such wells are more expensive than production wells for several reasons. In particular, injection wells must be insulated to withstand high temperatures so that the bottom end does not burn off before the gasification process has advanced significantly toward the production wells. Conversely, when the burn front has reached the production wells, the intermediate zone of deposit has already been largely produced and damage to the production well becomes less of a factor. Furthermore, the injection well normally requires more complicated construction than a production well.

The foregoing descriptions of the method of this invention are illustrative only and other arrangements and variations thereof will be evident to those skilled in this art without departing from the scope of the invention as set forth particularly in the appended claims.

What is claimed is:

1. A process for gasification of underground carbonaceous deposits comprising the steps of:

(a) positioning plural alternate substantially parallel contiguous rows of injection well bores and production well bores to establish a block gasification pattern;

(b) combustion linking each of said injection well bores with the production well bores adjacent thereto along oppositely directed paths substantially perpendicular to said rows;

(c) igniting said block pattern simultaneously through all said injection well bores; and (d) gasifying said pattern along said oppositely directed linking paths.

2. A process as in claim 1 wherein said carbonaceous deposit is coal.

3. A process as in claim 1 wherein said carbonaceous deposit is a heavy oil deposit.

4. A process as in claim 1 wherein the rows at the extremes of said block pattern are composed of production well bores.

5. A process as in claim 1 wherein said block pattern is separated from any previously burned out area of said deposit by a barrier of arbitrary dimensions.

* * * * *